United States Patent [19]

Carel

[11] 4,177,505

[45] Dec. 4, 1979

[54] INDICATOR LIGHT WITH INCORPORATED CATADIOPTRIC ELEMENT FOR AUTOMOBILE

[75] Inventor: Pierre Carel, Le Petit Clamart, France

[73] Assignee: Cibie Projecteurs, Bobigny, France

[21] Appl. No.: 861,782

[22] Filed: Dec. 19, 1977

[30] Foreign Application Priority Data

Jan. 24, 1977 [FR] France ..... 77 01895

[51] Int. Cl.[2] ..... F21V 7/00

[52] U.S. Cl. ..... 362/309; 362/328; 362/337; 362/339; 362/80

[58] Field of Search ..... 362/80, 299, 309, 335–340, 362/328

[56] References Cited

U.S. PATENT DOCUMENTS

| | | | |
|---|---|---|---|
| 2,224,178 | 12/1940 | Bitner | 362/337 |
| 2,343,754 | 3/1944 | Donley | 362/80 X |
| 2,356,654 | 8/1944 | Cullman | 362/336 X |
| 2,831,394 | 4/1958 | Heenan et al. | 362/337 X |
| 3,275,825 | 9/1966 | Welty | 362/332 |
| 3,435,200 | 3/1969 | Massoll et al. | 362/83 |
| 3,767,288 | 10/1973 | Gross | 362/80 X |
| 3,809,880 | 5/1974 | Daumueller et al. | 362/80 |
| 3,829,680 | 8/1974 | Jones | 362/339 X |
| 4,115,843 | 9/1978 | Nagel | 362/337 X |

FOREIGN PATENT DOCUMENTS

| | | | |
|---|---|---|---|
| 224016 | 7/1910 | Fed. Rep. of Germany | 362/328 |
| 2647090 | 10/1976 | Fed. Rep. of Germany | 362/80 |

*Primary Examiner*—Peter A. Nelson

*Attorney, Agent, or Firm*—Cullen, Sloman, Cantor, Grauer, Scott & Rutherford

[57] ABSTRACT

The present invention relates to an indicator light, particularly for an automobile, comprising a catadioptric element such that its position in the light and the preferred orientation of certain of its catadioptric prisms allow a zone adjacent the zone normally imposed by the geometry of the light to be illuminated. The invention is more particularly applied to the corner lights of automobiles.

5 Claims, 6 Drawing Figures

INDICATOR LIGHT WITH INCORPORATED CATADIOPTRIC ELEMENT FOR AUTOMOBILE

The present invention relates to indicator lights for an automobile, and more particularly to lights in which catadioptric elements are incorported.

In a conventional type of construction of such lights, the catadioptric elements are constituted by a plate of transparent material (for example glass), the outer surface of which is substantially flat and the inner surface of which is constituted by prisms. The catadioptric prisms are most often sections of right-angled polyhedrons (generally trirectangular trihedrons).

In a usual embodiment, some of these prisms are separated by flat surfaces parallel to the outer surface of the catadioptric element so that, the catadioptric element being associated with a lamp and a reflector, the zone of the flat surfaces acts as a plate with parallel faces so as to transmit the light rays from the lamp or reflected on the reflector without deflecting the direction thereof, the catadioptric prisms then functioning, for a beam of determined directions of incidence with respect to the axis of these prisms, as total-reflexion prisms.

In this latter case where the catadioptric element is used for transmitting the light rays issuing from inside the light, the conventional arrangments of prisms and catadioptric element enable only part of these light rays to be effectively used, namely those which strike the flat surfaces parallel to the outer face of the catadioptric element.

In fact, a necessary condition for the prisms to function as total-reflexion prisms in as wide a beam as possible, is that the refraction index of the material used must be as high as possible.

An immediate consequence of this necessity is that, in the conventional arrangements of prisms and catadioptric element, the light rays, which, from inside the light, strike the facets of the prisms, are deflected too much (due to the high refraction index and the inadequate angle of incidence of the rays on the facets) to be usable.

The present invention proposes a preferred orientation of the prisms and a judicious orientation of the catadioptric element, so that the light rays which strike a type of facet of the prisms according to the invention are sufficiently little deflected to be able usefully to form, preferably in a horizontal plane, a field adjacent the field of the directly transmitted rays.

The immediate interest of such a device therefore lies in the fact that signalling is allowed in directions where the geometry of the light (disposition on the vehicle or shape of the light base) would not allow this, the supplementary illumination not presenting any discontinuity with the illumination normally obtained with known devices.

The invention will be more readily understood on reading the following description with reference to the accompanying drawings, in which.

Figure 1:
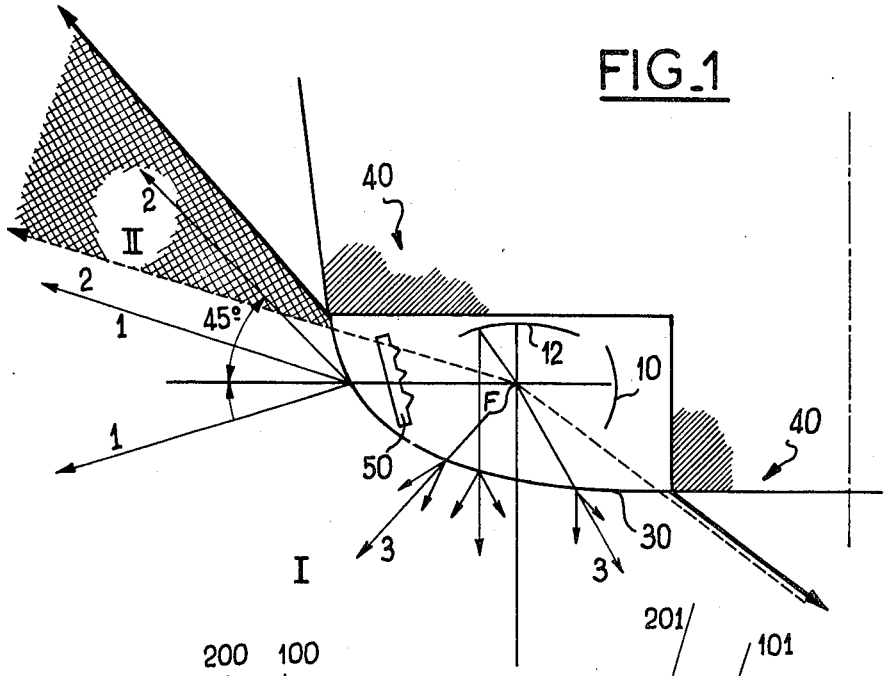
FIG. 1 shows a corner light (rear left) for automobile, in schematic section with the supplementary illuminating beam (II)

Referring now to the drawings, the corner light according to the invention conventionally comprises a base 40, an axial reflector 12 and a lateral reflector 10, of substantially perpendicular axes, the foci of said reflectors being at the location of the filament F of a lamp 20, a transparent glass 30 adapted to effect a slight diffusion of the light rays passing therethrough cooperating by known means with the base 40. Inside said light and near the glass there is placed, transversely with respect to the axis of the reflector 10, a transparent catadioptric element 50, whose outer face E is substantially flat and whose inner face is composed of catadioptric prisms, of which the three types of facets (F2, G2, H2) form trirectangular trihedrons separated, in a zone forming a window useful for illumination, by flat surface F1 parallel to the outer face E of said catadioptric element 50.

According to the invention, the orientation of the catadioptric prisms in the useful illumination window zone is such that, on the one hand, the axis of symmetry (ternary) of said trihedrons is perpendicular to the outer face of the catadioptric element so that these trihedrons function as total-reflexion prisms in a beam centred on this axis (thus perpendicularly to said outer face of the catadioptric element), on the other hand the faces F2 are located in a vertical plane so that they form with the outer face E prism elements of which the principal edge faces the rear of the vehicle.

Under these conditions, concerning the flat surfaces F2 and light rays issuing directly from lamp 20 or reflected by reflector 10, the catadioptric element, functioning as a prism, deflects said light rays 2 towards the front of the vehicle, in a horizontal plane.

Figure 5:
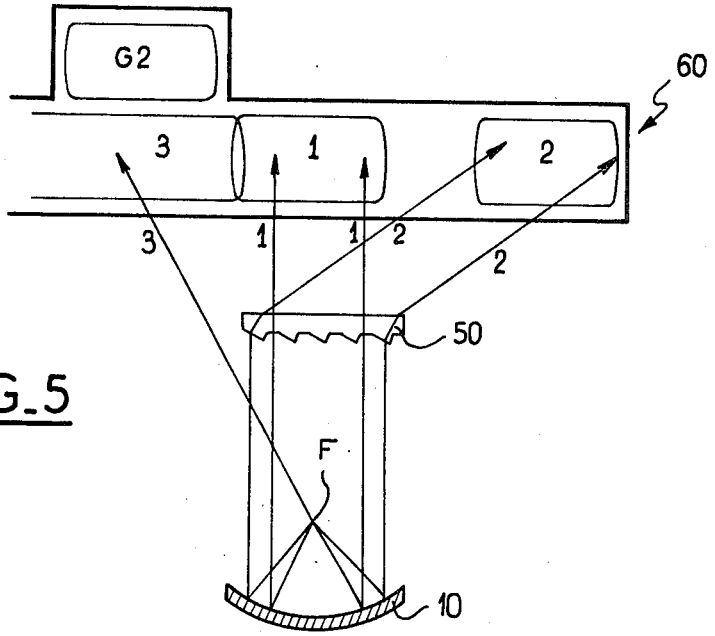
FIGS. 5 and 6 show the zones illuminated on a screen by the catadioptric element, according to its inclination.

If the refraction index is high (condition for obtaining a very open beam of catadioptric directions), the image on a lateral screen 60 of the light flux transmitted by the light, will be the one shown in FIG. 5, in which 1 represents the light rays transmitted by the flat surfaces F1, 2 those transmitted by facets F2, G2 those transmitted by facets G2, 3 representing the light rays issuing directly from the lamp and not passing through the catadioptric element. On the screen 60, the various rays create illuminated zones having corresponding references.

It should be observed that the beams of rays 1, 2 and G2 leaving the light are not, in practice, parallel beams: in fact, a certain divergence of these beams is obtained on the one hand due to diverse diffusions (particularly through the glass), and on the other hand due to the very divergence of the light rays passing through the catadioptric element.

Figure 4:
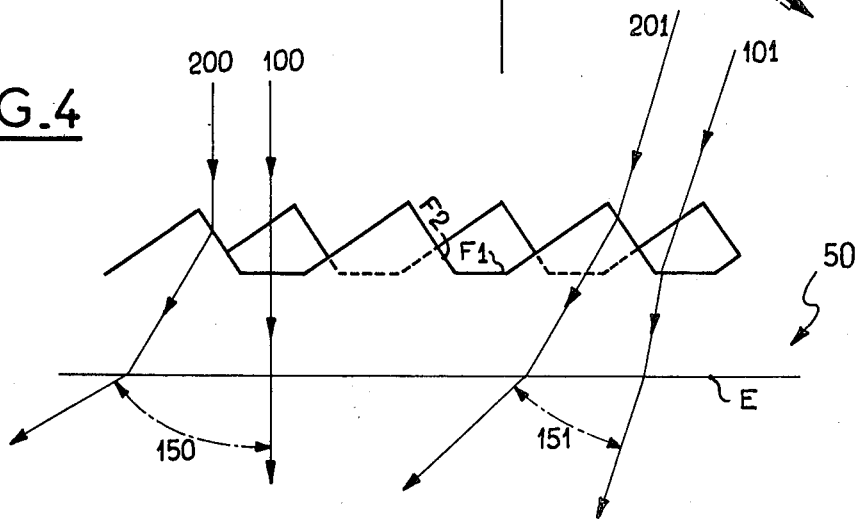
FIG. 4 shows a section aling line A—A of FIG. 3 through the catadioptric element and the paths of light rays according to the incidence on the catadioptric element.
Figure 3:
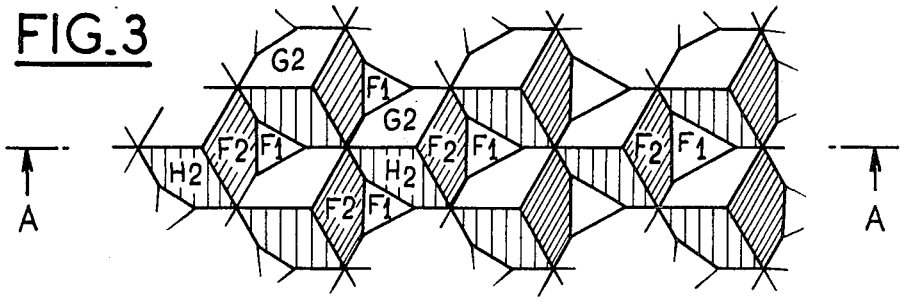
FIG. 3 shows an elevation of the inner face of the catadioptric element.
Figure 2:
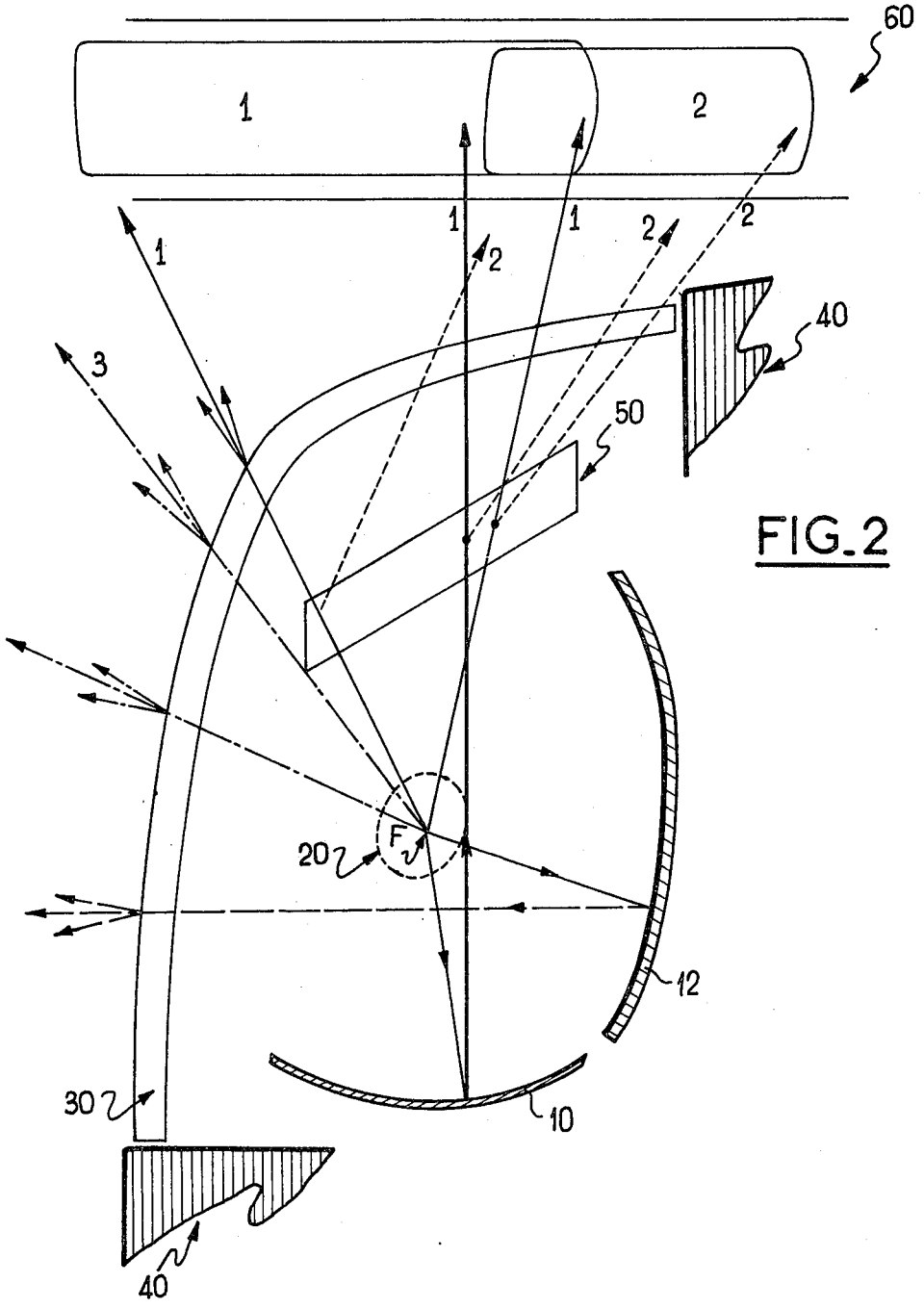
FIG. 2 shows a section in a horizontal plane of a light according to the invention.

According to another feature of the invention, it is possible to obtain the joining of zones 1 and 2. In fact, by inclining the catadioptric element with respect to the axis of the reflector 10, it is possible to bring the deflection 150 of rays 200 and 100 to a deflection 151, as rays 201 and 101 then no longer have an incidence perpendicular to the outer face E. (cf. FIG. 4).

Figure 6:
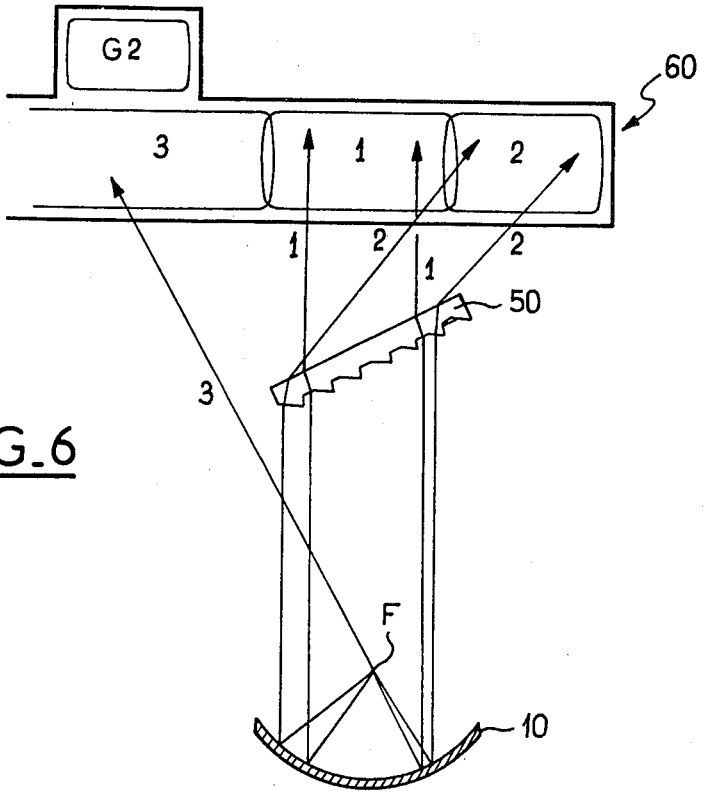

FIG. 6 illustrates such a joining of the illuminated zones 1 and 2 due to the inclination of the catadioptric element 50, with respect to its position shown in FIG. 5, where the zones 1 and 2 are separate.

The inclination of the catadioptric element therefore makes it possible to illuminate, in addition to the usually illuminated zone I, a zone II (FIG. 1) adjacent zone I in a horizontal plane and located towards the front of the vehicle.

A further advantage of this arrangement of prisms is that the beam G2 directed upwardly to the left and to the rear may be used to indicate the presence or the manoeuvring of a vehicle provided with this type of light to the driver of another vehicle located near the first vehicle - and to the rear thereof in the present case.

On the other hand, in the zone of the catadioptric element not serving as useful illumination window, the inner face (for reasons of catadioptric performance) will advantageously be provided solely with prisms of the above-mentioned type. However, their axes may advantageously be directed differently from those of the prisms of said window, particularly parallel to the axis of the lateral reflector, so as to enlarge the beam of the catadioptric directions.

A light according to the invention will therefore fulfill the functions of indicator, for which it is intended, much more satisfactorily, by the optimum use of the different light fluxes and by an enlargement of its catadioptric field.

An immediate application of the invention is the production of "corner" lights for vehicles, but this is, of course, not limiting.

What is claimed is:

1. In an indicator light with a catadioptric element for automobiles comprising an exterior diffusing glass, a reflector having a longitudinal axis, a light source, and a transparent catadioptric element placed transversely with respect to said axis so as to intercept a part of the light beam reflected by the reflector, said catadioptric element having a substantially flat outer face and an inner face composed of a plurality of prisms, located in a useful illumination window zone, separated by flat surfaces parallel to the outer surface, said flat surfaces allowing the emission by light of an illuminating flow centered on the axis of said reflector;

the improvement comprising said catadioptric prisms each presenting one facet defining with the outer surface of the catadioptric element a deflector prism which deviates light rays emitting a second illumination flow adjacent the first illuminating flow.

2. In the light of claim 1, said catadioptric prisms being selected from the group comprising trirectangular trihedrons and right-angular dihedrons, in said zone, the axes of said right-angled polyhedrons being perpendicular to said outer face, one of the facets of each prism being located in a vertical plane, the outer face of said catadioptric element being inclined to the reflector axis whereby said second illumination flow is transmitted by the light in a horizontal plane adjacent said first illumination flow.

3. The light of claim 2, said catadioptric prisms of the illumination window zone being trirectangular trihedrons, one of the facets of each trihedron being located in a vertical plane to obtain said second illumination flow adjacent the first illumination flow, and one of the facets being directed upwardly to obtain a third, upwardly directed illumination flow.

4. The light of claim 1, wherein outside the illumination window zone, the axis of the catadioptric prism is substantially parallel to the axis of the reflector.

5. The light of claim 1, wherein the axis of the reflector is directed laterally with respect to the vehicle, and further comprises an axial reflector cofocal with the first reflector, adapted to reflect a second beam perpendicular to said first illumination flow outside of said catadioptric element, so that the light field emitted by the light successively comprises, in a horizontal plane and in the direction axial with respect to the lateral direction, the flow reflected by the axial reflector, the rays emitted directed by the lamp, said first illumination flow and said second illumination flow, said light field being continuous from the axial direction to the direction of said second illumination flow.

* * * * *